US010337844B1

(12) United States Patent
Wall

(10) Patent No.: US 10,337,844 B1
(45) Date of Patent: Jul. 2, 2019

(54) LONG WEAR SNAP CAP

(71) Applicant: Lloyd LeRoy Wall, LaVerkin, UT (US)

(72) Inventor: Lloyd LeRoy Wall, LaVerkin, UT (US)

( * ) Notice: Subject to any disclaimer, the term of this patent is extended or adjusted under 35 U.S.C. 154(b) by 0 days.

(21) Appl. No.: 16/050,356

(22) Filed: Jul. 31, 2018

(51) Int. Cl.
*F42B 8/00* (2006.01)
*F42B 8/08* (2006.01)

(52) U.S. Cl.
CPC ..... *F42B 8/08* (2013.01)

(58) Field of Classification Search
CPC ..... F42B 8/00; F42B 8/02; F42B 8/08
USPC ..... 102/444
See application file for complete search history.

(56) References Cited

U.S. PATENT DOCUMENTS 3,027,840 A * 4/1962 Hannas ..... F42B 8/08
102/444

* cited by examiner

*Primary Examiner* — J. Woodrow Eldred
(74) *Attorney, Agent, or Firm* — Gurr Brande & Spendlove; Robert D. Spendlove

(57) ABSTRACT

An impact energy suppression assembly for an inert ammunition cartridge is disclosed wherein the assembly includes a barrel, a piston and a compression resistant device. The barrel has a bottom wall with an opening, at least one generally cylindrical integral sidewall, and an open upper end, and the piston has a head and push rod which extends outwardly from the piston head for connection with the compression resistant device. The piston and compression resistant device are inserted into the assembly barrel which is inserted into the hollow cavity of inert firearm ammunition for use as a training device.

21 Claims, 3 Drawing Sheets

LONG WEAR SNAP CAP

FIELD OF THE INVENTION

The present invention relates generally to inert training ammunition and, in particular, an impact energy suppressor assembly inserted into training ammunition.

BACKGROUND

Inert training ammunition and devices for absorbing the energy of a firearm firing pin, which may be referred to as snap caps, are known in the art. Such devices are used in the place of a live round of ammunition for training purposes. The user of a firearm can load a training bullet as the user would with live ammunition and then proceed to use the firearm as he or she would with a live round allowing the user to learn how to use the firearm and to gain a better understanding of the feel and effect of the firearm. In use, the firing pin of a firearm is released, as it would be with a live round, and drives forward toward the chambered training ammunition. The training devices are constructed to receive and slow the forward motion of the firing pin. The goal is to have training ammunition that will match the feel and action of a live round. Such training devices are beneficial to individual firearms owners and to professionals, such as those training to become law officers or for officers using a new firearm. Use of a firearm with an inert training round, or "dummy round," provides for safer training of first-time shooters in military, law enforcement or civilian settings and for safer handling of a firearm when the user transitions to a firearm having live rounds.

Training ammunition devices currently known in the art typically comprise aluminum shell cases with polymeric primers that are cast-in-place or comprise plastic shell cases with spring-loaded inert polymeric primers. Though these devices are beneficial for training purposes, they have drawbacks.

The known aluminum devices are weak and subject to extraction rim breakage. They also lack acceptable levels of lubricity, and thus when they are used within a firearm they produce chards, shavings and dust which can contaminate the firearm. The result of these deficiencies is a training ammunition device that has a low life expectancy and which damages the firearms in which it is used.

The known plastic shell cases are beneficial mostly because they are inexpensive and easy to produce. However, the such devices are significantly lighter in weight than live rounds, and thus it does not properly replicate the feeling and firing of a metal shell live round, and, as with the aluminum devices, the material provides for a low life expectancy requiring a user to purchase the devices more frequently than should be necessary.

Though the aluminum and plastic training ammunition can simulate the firing of a firearm, none duplicate the actual weight, feed, and firing characteristics of a live round of ammunition. The present disclosure addresses these and other deficiencies in existing training ammunition by providing various advantages, including an impact energy suppressor assembly that can be used with a shell of any ammunition caliber.

BRIEF DESCRIPTION OF THE DRAWINGS

Advantages of the invention will become apparent upon reading the following detailed description and upon reference to the drawings.

Figure 1:
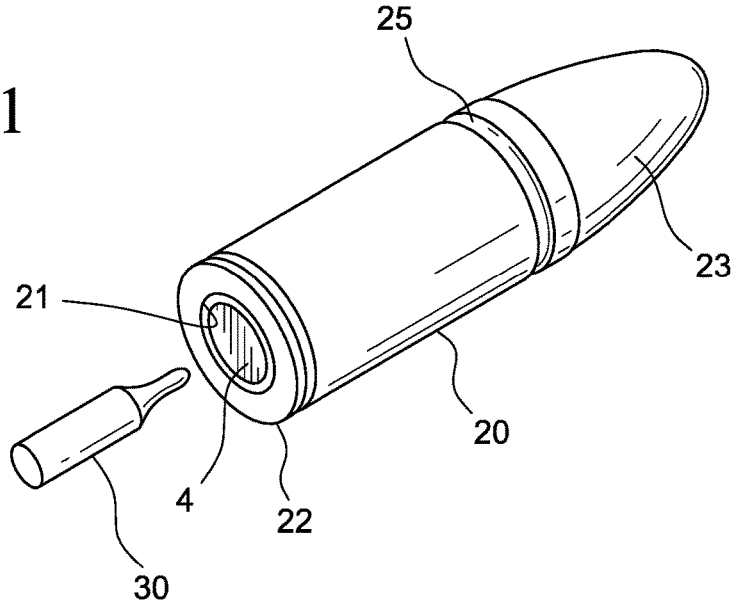
FIG. 1 is a perspective view of a training ammunition device with an impact energy suppressor according to an embodiment of the present disclosure.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention.

DESCRIPTION OF ILLUSTRATIVE EMBODIMENTS

Embodiments of the invention are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, forward and rearward, and the like may be used solely to distinguish one entity or action from another entity or action without necessarily requiring or implying any actual such relationship, direction or order between such entities or actions.

Figure 2:
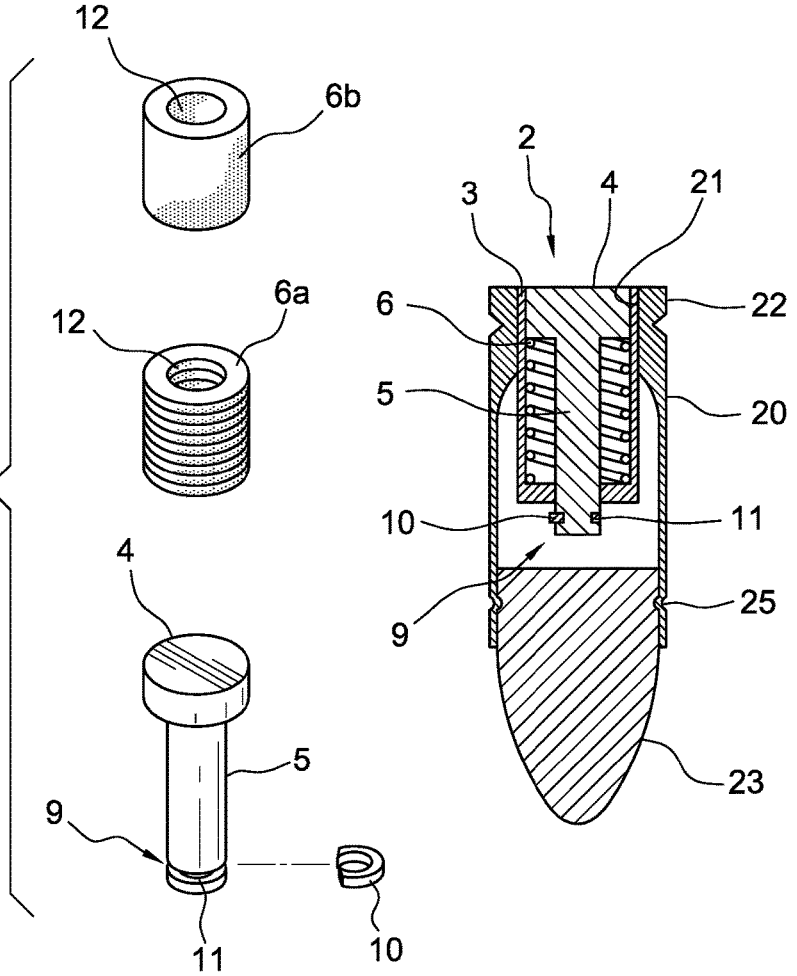
FIGS. 2 and 3 are cross-section views of a training ammunition device with an impact energy suppressor according to embodiments of the present disclosure.
Figure 3:
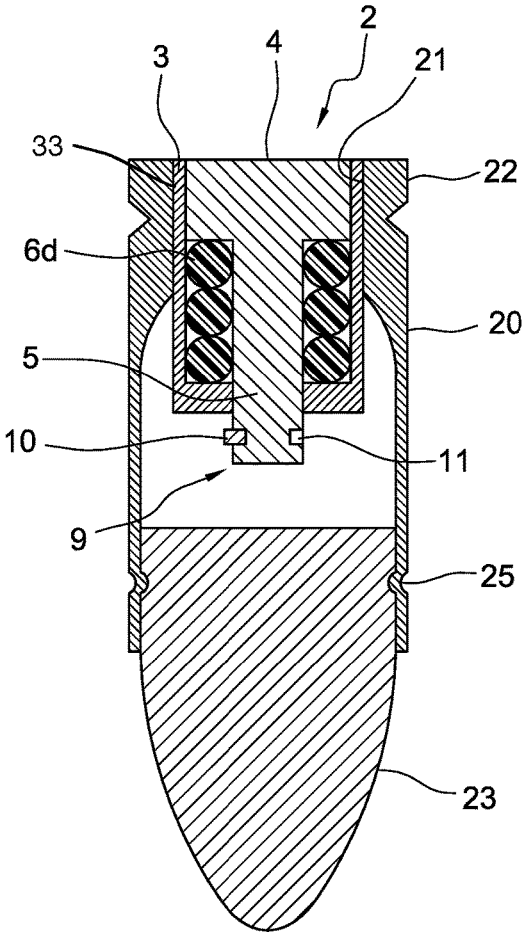
Figure 4:
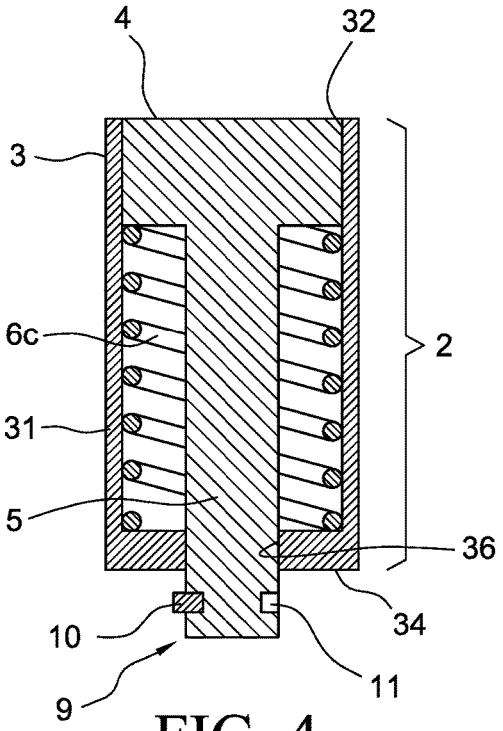
FIGS. 4 and 5 are cross-section views of an impact energy suppressor assembly according to embodiments of the present disclosure.
Figure 5:
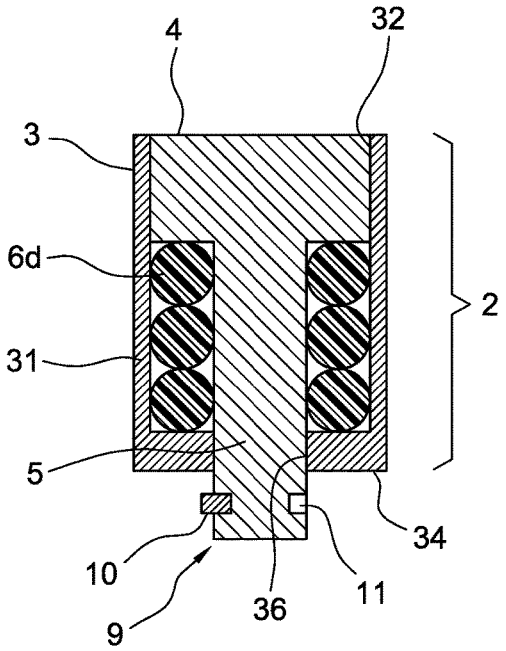

FIGS. 1-3 show exemplary embodiments of the impact energy suppressor of the present disclosure. They show the components of the impact energy suppressor assembly 2 inserted into the primer pocket 21 of a center-fire shell 20 at the shell head 22. Once the impact energy suppressor 2 is assembled (detailed below), the suppressor barrel 3 is inserted into the shell head 22, which is preferably a brass shell cartridge. The shell 20 includes bullet lock grooves 25 and a bullet 23 for providing the same feel, feed and experience a user would have with a live round of ammunition. In this embodiment, the bullet 23 is seated and crimped in the shell case 20. Without properly securing the bullet 23 in the shell case 20, repeated use of the shell and impact from the firing pin 30 could cause the bullet to dislodge from the shell case. Ammunition with components other than those shown in FIGS. 1-3 are contemplated by the present disclosure. However, it is an advantage of embodiments of the present invention that the ammunition used have the same shell and components as those used with a live round, providing for a realistic experience with the training devices.

FIGS. 2-5 illustrate embodiments of the impact energy suppressor assembly. The impact energy suppressor assembly 2 comprises an impact force suppressor barrel 3 in which an inert simulated primer piston, having piston head 4 and a push rod 5, and a compression resistance device 6 (FIG. 2)

are inserted. The suppressor barrel 3 comprises a generally cylindrical sidewall 31 with an open top end 32 and a closed bottom end 34. The closed end may include a through hole 36.

An outside surface of the sidewall 31 may include an interlock 33 that fixes the impact suppressor assembly against movement relative to the shell case 20. The interlock may be formed by forming a chamfered or radiused thrust bearing surface adjacent the opening of the primer pocket 21 and flaring the open end of the suppressor barrel 3 to match the chamfer of the primer pocket such that the suppressor barrel is prevented from moving forward relative to the shell case 20 when the firearm firing pin impacts the suppressor assembly. Alternatively, other engagement elements may be used. For example, the open end of the primer pocket 20 may included a countersunk or counterbored hole extending from the open end, and the suppressor barrel may include a ring or other protrusion formed on the outside surface of the sidewall such that the ring engages the hole surface or a step formed by the hole. Engagement of the sidewall extension and hole prevent the suppressor barrel from moving forward relative to the shell case 20.

The compression resistance device 6 is inserted into the open end 32 of the barrel 3 and seats against an inside surface of the closed end 34. The piston may be generally cylindrical with a T-shaped cross-section, with the head 4 positioned adjacent the open end 32 of the barrel 3, and post 5 extending downward from the head through the barrel and extend from the through hole 36. The piston push rod 5 may comprise a retention feature 9 near its distal end. This feature may comprise a recessed portion 11, such as a groove, slot, recess or similar used in combination with a fastener 10, such as a C-clip, O-ring, retaining ring or other similar device. Alternatively, the retaining feature may be formed by staking an exterior surface of the rod or may use a self-locking retaining ring that engages the exterior surface of the rod. The retaining feature 9 retains the piston rod 5 and head 4 in the interior of the barrel 3, which also keeps the compression resistance device 6 secured in the interior of the barrel. It will be understood by those of skill in the art that other known methods for securing the push rod 5 with the barrel 3 could be used. The assembly 2 can be manufactured to fit all types of ammunition with any caliber.

The compression resistance device 6 modulates the firing pin (30) forward velocity and de-energizes the impact energy of the firing pin. The compressive resistance device 6 includes a central passage 12 through which the piston rod 5 passes. Embodiments of the resistance device may include various compressive elements, alone or in combination. For example, these elements may comprise a metallic spring 6*c*, an elastomeric cylindrical tube 6*b*; a stack of elastomeric washers 6*a*; or a stack of one or more O-rings 6*d*. Such elastomeric elements may comprise rubber, plastic, thermoplastic elastomer, or other elastomeric materials.

Referring now to FIG. 3 there is a cross-section of one embodiment of the impact energy suppressor assembly 2 inserted into a small caliber standard production brass shell case 20 with a polymeric tubular compression resistant device 7 for modulating the forward velocity of the firing pin (30) and de-energizing the impact energy of the firing pin. When the suppressor assembly 2 is inserted into the modified primer pocket 21 at the cartridge shell head 22, the inert ammunition can be loaded into a firearm (not shown), the trigger sear (not shown) engaged, and the firing pin (30) released. The pin contacts the piston head 4 and modulates the forward travel of a live round driving the piston forward forcing the compression resistant device 7 to compress, slowing down and ultimately stopping the firing pin. As discussed above, the push rod 5 includes a retaining feature 9 to ensure that the assembly remains intact.

Embodiments of the disclosure are adaptable to all center-fired shells. The assembly can be matched to the impact energy of a specific firearm model—small firearms have less impact energy than large firearms. Use of the impact energy suppressors detailed herein can preserve the free-floating firing pin and trigger mechanism from cold metal extrusion and/or breakage. Further, because the impact energy suppressors of the present disclosure can be so easily modified and adapted to all center-fired shells of any caliber, the manufacturing process is simpler and more cost effective than with the aluminum or plastic training devices, both of which require complete tooling and fabrication for every firearm caliber.

As noted above, embodiments of the present disclosure contemplate the use of genuine brass shell cases for use with the impact energy suppressor. The brass cases can be made from production run brass shell cases and components, thus retaining the shell case dimensions, weight and handling qualities. The use of such brass cases provides improvements to the function and life of the training ammunition as well as improvements to a user's training since the weight and feed of the brass devices is nearly identical to live rounds.

Beyond the benefits of brass metal for the feed and weight of the training devices, such metal is generally stronger than aluminum and plastic providing for a longer life of a device comprised of a brass shell. Further, the lubricity of brass metal is typically in the range of 3 to 4 pounds per square inch before galling occurs, which is up to 150% greater than the lubricity of aluminum which is typically in the range of 2 to 2.9 pounds per square inch. The use of brass metal also allows a user to analyze how the firing pin is functioning because brass captures the impact print of the firing pin, whereas for polymeric primer surfaces the firing pin imprint is difficult to see if it can be seen at all. These advantages provide a training device that will last longer than those currently found in the market and one which will not contaminate a firearm to the extent of aluminum.

Because actual shells normally used with live ammunition are used for the devices of the present disclosure, it is important to ensure a user can note the difference between training shells and live rounds. To prevent misidentification, some embodiments of the present disclosure include a shell case and bullets that have contrasting colors to make it easier to distinguish a live round from a dummy round.

Figure 6:
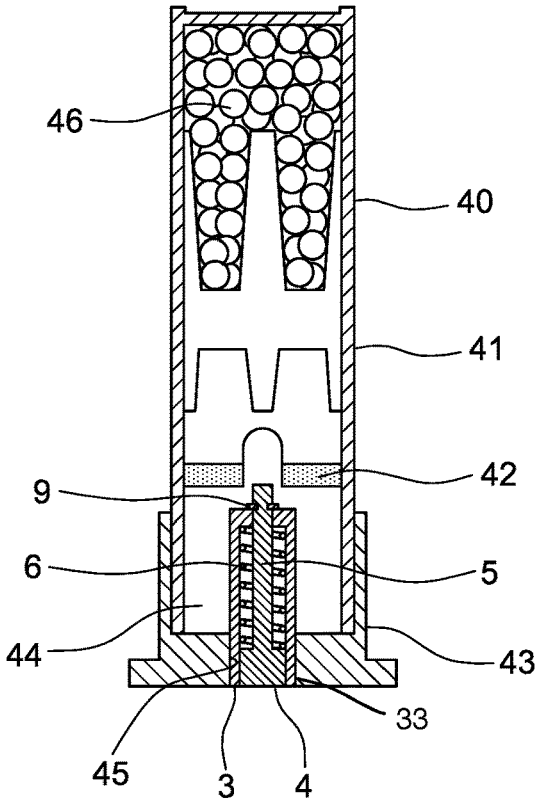
FIG. 6 is a cross-section view of a decommissioned shotgun shell with an impact energy suppressor according to an embodiment of the present disclosure.

Referring now to FIG. 6 there is yet another embodiment of the present disclosure showing a cross section of the energy impact suppressor assembly 2 (FIG. 5) inserted into a decommissioned polymeric shot gun shell case 40 with a decommissioned powder chamber 44 accessed through a modified cartridge primer pocket 45. The shell case 40 has an undisturbed lead shot 46, shotgun shot choke 41, and shotgun shell wad 42. The decommissioned powder chamber 44 may be filled with a material that replaces the powder and provides additional support for the cartridge. The filler material may include epoxy, hardening putty or other material, which is instered into the cartridge and then hardens. As with the other embodiments described above, the barrel 3, primer piston head 4, compression resistant device 6, and push rod 5 are all connected and mounted in the shotgun shell primer pocket 45 for use when the gun is fired to receive and de-energize the force of the shotgun firing pins.

Figure 7:
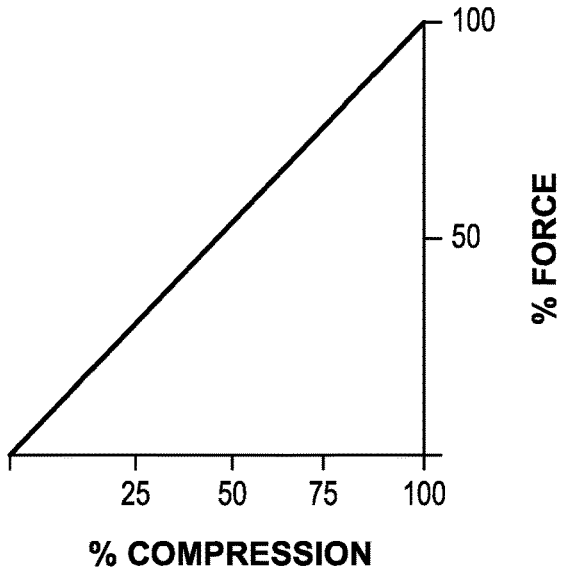
FIG. 7 is a graph showing the relationship between the compression resistance of the energy suppressors detailed in the present disclosure as related to the impact force of a firing pin on those energy suppressors.

FIG. 7 is a force graph that correlates the percent compression of the compression resistant device to the force imposed upon the simulated primer piston head 4. As is shown, there is an inverse relationship between the two. Therefore, when the impact force of a firing pin increases, a more rigid compression resistant device is needed to decrease the level of compression. As the force of the firing pin decreases, compression resistant device can allow for increased compression to better replicate the feed and fire of live ammunition.

While the present invention has been described with reference to one or more particular embodiments, those skilled in the art will recognize that many changes may be made thereto without departing from the spirit and scope of the present invention. Furthermore, components from one embodiment can be used in other non-exclusive embodiments. Each of these embodiments and obvious variations thereof is contemplated as falling within the spirit and scope of the invention.

What is claimed is:

1. An inert ammunition cartridge for use as a training replacement for a predetermined live ammunition round, the inert ammunition cartridge comprising:

a shell case comprising a head, wherein the shell case further comprises the same material and has the same profile, exterior dimensions, and interior dimensions as a shell case of the live ammunition round; and an impact energy suppression assembly that is inserted into the shell case head, the impact energy suppression assembly comprising:

a barrel having a bottom wall with an opening configured to receive a piston push rod, at least one generally cylindrical sidewall substantially perpendicular to the bottom wall, and an open upper end, wherein the diameter of the bottom wall opening is less than the diameter of the open upper end;

a piston having a head and push rod, the push rod extending outwardly from the piston head, wherein the piston head has a diameter less than the diameter of the barrel open upper end and the push rod has a diameter less than the diameter of the bottom wall opening; and a compression resistant device configured to receive the piston push rod, wherein the compression resistant device is connected with the piston and mounted within the barrel.

2. The inert ammunition cartridge of claim 1 wherein the piston push rod comprises a retaining device at a distal end.

3. The inert ammunition cartridge of claim 1 wherein an outside diameter of the barrel sidewall is less than an outside diameter of the shell case.

4. The inert ammunition cartridge of claim 1 wherein the piston and compression resistant device comprises a polymeric substance.

5. The inert ammunition cartridge of claim 1 wherein the compression resistant device has a compression resistance directly proportional to an impact force of a firearm firing pin.

6. An inert ammunition cartridge for use as a training replacement for a predetermined live ammunition round, the inert ammunition cartridge comprising:

a shell case comprising an elongated body having a front end, a rear end, at least one sidewall, and a cavity arranged adjacent the rear end, wherein the shell case has the same exterior, interior and sidewall dimensions as a shell case of the live ammunition round; and an impact energy suppression assembly that is inserted into the shell case body rear end, the impact energy suppression assembly comprising:

a barrel having a bottom wall with an opening configured to receive a piston push rod, at least one generally cylindrical sidewall substantially perpendicular to the bottom wall, and an open upper end, wherein the diameter of the bottom wall opening is less than the diameter of the open upper end;

a piston having a head and push rod, the push rod extending outwardly from the piston head, wherein the piston head has a diameter less than the diameter of the barrel open upper end and the push rod has a diameter less than the diameter of the bottom wall opening; and a compression resistant device configured to receive the piston push rod, wherein the compression resistant device is connected with the piston and mounted within the barrel.

7. The inert ammunition cartridge of claim 6 wherein a portion of the body sidewall has a generally conical configuration of narrowing diameter toward the body front end.

8. The inert ammunition cartridge of claim 7 wherein a portion of the body sidewall has a generally cylindrical configuration extending from the body sidewall portion with the generally conical configuration to the body rear end.

9. The inert ammunition cartridge of claim 6 further comprising a bullet connect with the shell case body front end, wherein the shell case and bullet are connected with a crimped groove.

10. The inert ammunition cartridge of claim 6 wherein the piston push rod comprises a retaining device at a distal end.

11. The inert ammunition cartridge of claim 6 wherein an outside diameter of the barrel sidewall is less than an outside diameter of the generally cylindrical body sidewall portion.

12. The inert ammunition cartridge of claim 6 wherein the compression resistant device comprises a polymeric substance.

13. The inert ammunition cartridge of claim 6 wherein the compression resistant device has a compression resistance directly proportional to an impact force of a firearm firing pin.

14. An inert ammunition cartridge for use as a training replacement for a predetermined live ammunition round, the inert ammunition cartridge comprising:

a shell case comprising an elongated, generally cylindrical hollow body having a front wall, a generally cylindrical sidewall, a rear end, and a cavity adjacent to the rear end, wherein the shell case has the same exterior, interior and sidewall dimensions as a shell case of the live ammunition round; and an impact energy suppression assembly that is inserted into the shell case body rear end, the impact energy suppression assembly comprising:

a barrel having a bottom wall with an opening configured to receive a piston push rod, at least one generally cylindrical integral sidewall substantially perpendicular to the bottom wall, and an open upper end, wherein the diameter of the bottom wall opening is less than the diameter of the open upper end;

a piston having a head and push rod, the push rod extending outwardly from the piston head, wherein the piston head has a diameter less than the diameter of the barrel open upper end and the push rod has a diameter less than the diameter of the bottom wall opening; and a compression resistant device configured to receive the piston push rod, wherein the compression resistant device is connected with the piston and mounted within the barrel.

15. The inert ammunition cartridge of claim 13 wherein the piston push rod comprises a retention feature at a distal end.

16. The inert ammunition cartridge of claim 14 wherein the compression resistant device comprises a metal material.

17. The inert ammunition cartridge of claim 15 wherein the compression resistant device comprises a polymeric substance.

18. The inert ammunition cartridge of claim 16 wherein the compression resistant device has a compression resistance directly proportional to an impact force of a firearm firing pin.

19. The inert ammunition cartridge of claim 1 wherein the shell case is a shell case manufactured for use in the live ammunition round.

20. The inert ammunition cartridge of claim 19 wherein the shell case is derived from a decommissioned live ammunition round.

21. The inert ammunition cartridge of claim 1 wherein the shell case head further comprises a primer pocket, and wherein the impact energy suppression assembly is inserted into the primer pocket.

* * * * *